United States Patent [19]

Bittner

[11] Patent Number: 4,680,820

[45] Date of Patent: Jul. 21, 1987

[54] CONVERTIBLE WATER BED

[76] Inventor: Ronald D. Bittner, 12418 Quail Woods Dr., Germantown, Md. 20874

[21] Appl. No.: 814,498

[22] Filed: Dec. 30, 1985

[51] Int. Cl.[4] ..... A47C 27/08; A47B 83/00

[52] U.S. Cl. ..... 5/451; 5/2 R; 5/8

[58] Field of Search ..... 5/451, 452, 455, 449, 5/450, 2 R, 8, 9

[56] References Cited

U.S. PATENT DOCUMENTS

| | | | |
|---|---|---|---|
| 2,243,691 | 5/1941 | Bakalar | 5/93 R |
| 4,180,878 | 1/1980 | Howell | 5/451 |
| 4,266,307 | 5/1981 | Critelli | 5/451 |

FOREIGN PATENT DOCUMENTS

| | | | |
|---|---|---|---|
| 3410918 | 10/1985 | Fed. Rep. of Germany | 5/2 R |

*Primary Examiner*—Alexander Grosz
*Attorney, Agent, or Firm*—Randall G. Erdley

[57] ABSTRACT

A convertible water bed comprising a bed frame, a water-filled mattress supported on the bed frame, a movable flexible mattress support member slidably connected at two opposite edges to side boards of the bed frame for movement between a use position above the water-filled mattress and a storage position below the water-filled mattress, and a flexible conventional mattress attached to the movable mattress support member for movement therewith between the use and storage positions, so that either the water mattress or the conventional mattress can be used by a simple manipulation of the bed assembly. The flexible support member in the use portion may lie on the upper surface of the water mattress so that the latter can be used as a lower support, in the nature of a box spring, for the conventional mattress.

11 Claims, 8 Drawing Figures

CONVERTIBLE WATER BED

BACKGROUND OF THE INVENTION

1. Field of the Invention

This invention relates to a water bed and more particularly to a water bed which is convertible into a conventional mattress type bed.

2. Description of the Prior Art

It is known that conventional water beds generally consist of a water filled mattress supported on a platform within a frame. Although water beds have become popular today and are in great use, they have the disadvantage that once installed they must always be used with the water-filled mattress and therefore one desiring to change the type of mattress to attain a variation in the sleeping surface, such as a conventional innerspring or foam-type mattress, for example, must go to another bed.

BRIEF SUMMARY OF THE INVENTION

One object of the invention is to overcome the above disadvantages by providing a new type water bed that is convertible to a conventional mattress type of bed so that one can selectively use either type of mattress.

Another object is to provide such a convertible bed which is of great advantage to hotels, motels, and hospitals, for example, to accomodate a variety of comforts for the many different individuals who will use the bed, thus obviating the necessity of providing two or more different categories of beds, which is an economic, as well as, practical savings.

The invention accomplishes this by providing a convertible water bed comprised of a frame support structure, a water mattress supported on the frame structure, and a movable supporting surface for supporting a conventional mattress, such as a foam rubber mattress, for example, supported on the frame structure for movement between a storage position below the water mattress support structure and a position for use in lieu of the water mattress above the latter. To facilitate the transfer of the movable support surface between these two positions, guide slots are provided in the side boards of the frame structure and one of the end boards has an open portion through which the movable support surface and mattress thereon travels.

BRIEF DESCRIPTION OF THE DRAWINGS

The invention will now be described in detail with reference to the accompanying drawings wherein.

DETAILED DESCRIPTION

Figure 1:
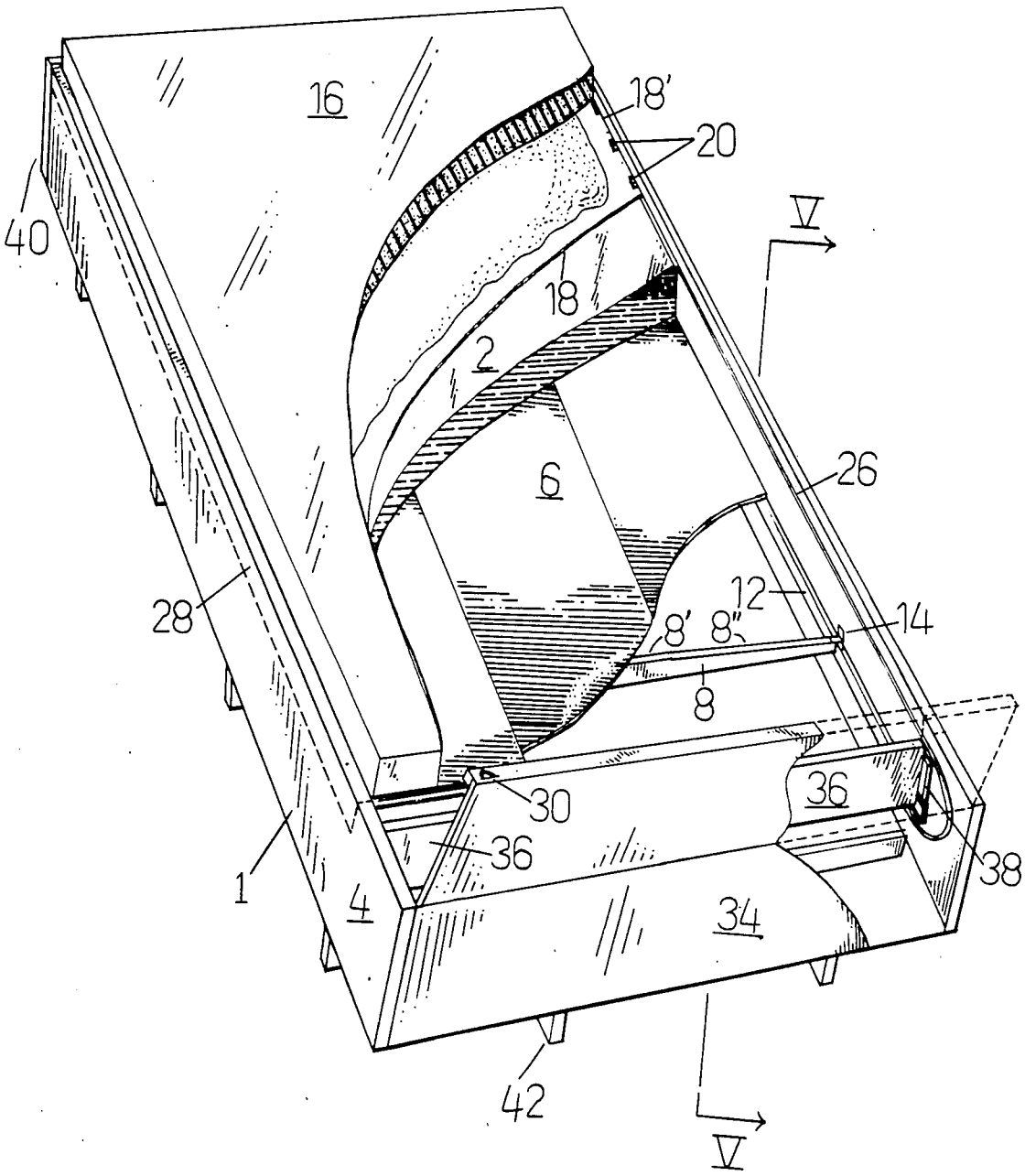
FIG. 1 is a perspective partially cut-away view showing features of the invention.

With reference to the figures, water mattress cell 2 is enclosed in a box-type frame support structure generally indicated at 1 and is supported by plywood decking 6. The decking 6 and water mattress cell 2 are supported by spaced cross beams 8 that rest at their ends in measured slots 10 in boards 12 secured below the decking edges on the longitudinal sides 4 of the frame support structure 1.

Each cross beam 8 is placed with its greater width vertically in the slots 10 and secured by L-shaped brackets 14. These brackets 14 keep the sides 4 of the frame support structure 1 from expanding outwardly. The cross beams 8 are shaped to have a flat top edge at the center portion 8' thereof and sloping outer top edges 8''. This extraverted shape contours the middle of the water mattress cell 2 so that it is shallower than the longitudinal sides, reducing the weight stress at the center portion 8' of the cross beams 8. Use of the cross beams 8 allows for a storage area beneath the water mattress cell 2 and its supporting structure.

Figure 2:
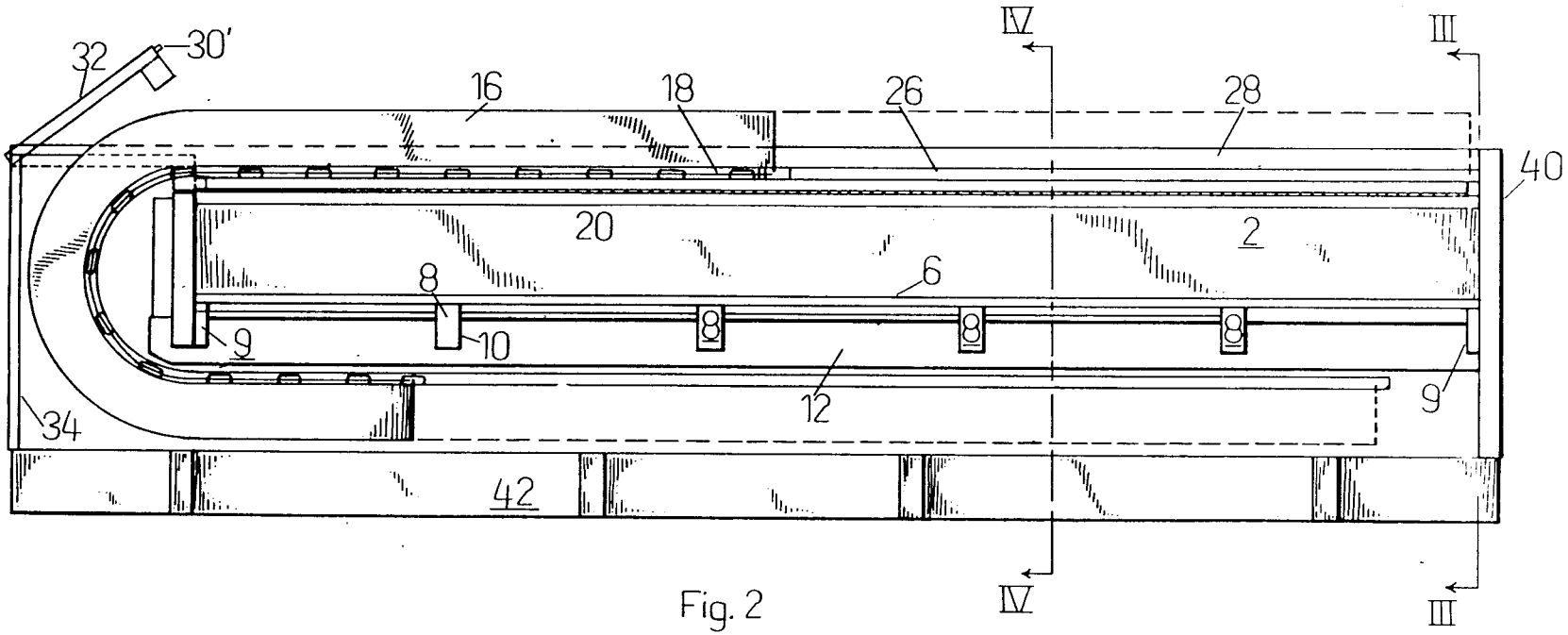
FIG. 2 is a side elevational view, partially schematic and partly in cross-section of the bed of FIG. 1 with near side board omitted to show certain features more clearly.
Figure 3:
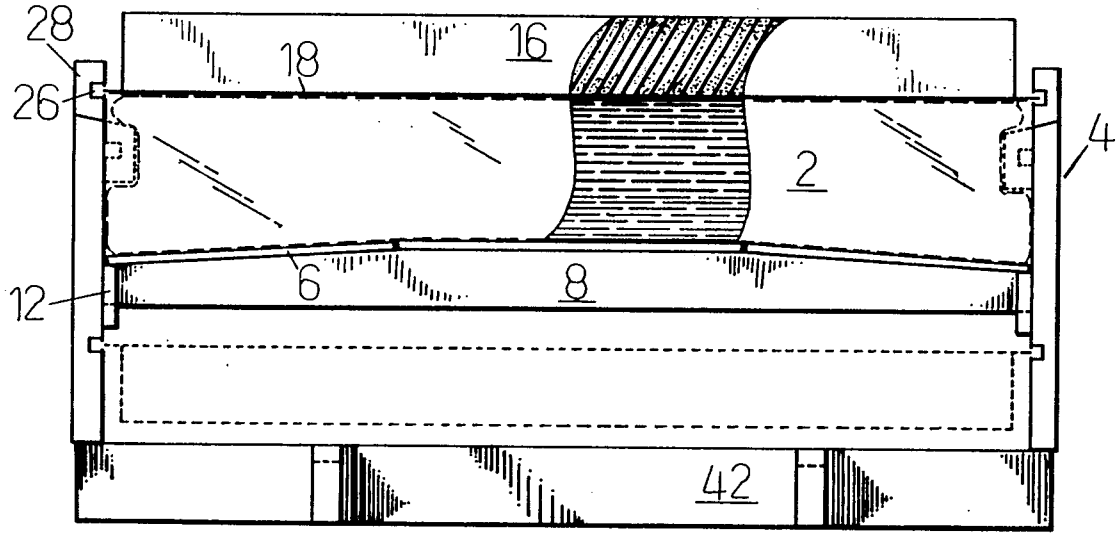
FIG. 3 is a partly cross-sectional elevational view taken along line III—III of FIG. 2.

Each sides 4 and ends 40 of the frame support structure 1 extend below the decking 6 to provide a hidden storage area for a foam mattress 16 that is adhered to the movable support surface or sheet of flexible plastic 18 as best shown in FIGS. 2 and 3. The plastic sheet 18 rests across the top surface of the water mattress cell 2 when in the position for use. The plastic sheet 18 is attached along its edges 18' to several self-lubricating plastic guides 20 by rivets 22, for example. The guides 20 slide freely in a metal track 24 (FIG. 6) and are secured at equal intervals on the longitudinal sides 18' of the plastic sheet 18.

The track 24 is inset and secured in a grooved channel 26 in and along the longitudinal sides 4 of the frame support structure 1. The channel 26 and the track 24 are preferrably centered on the plane of the top surface of the water mattress cell 2 and allow the plastic sheet 18 to slide across the top surface of the water mattress cell 2.

Figure 4:
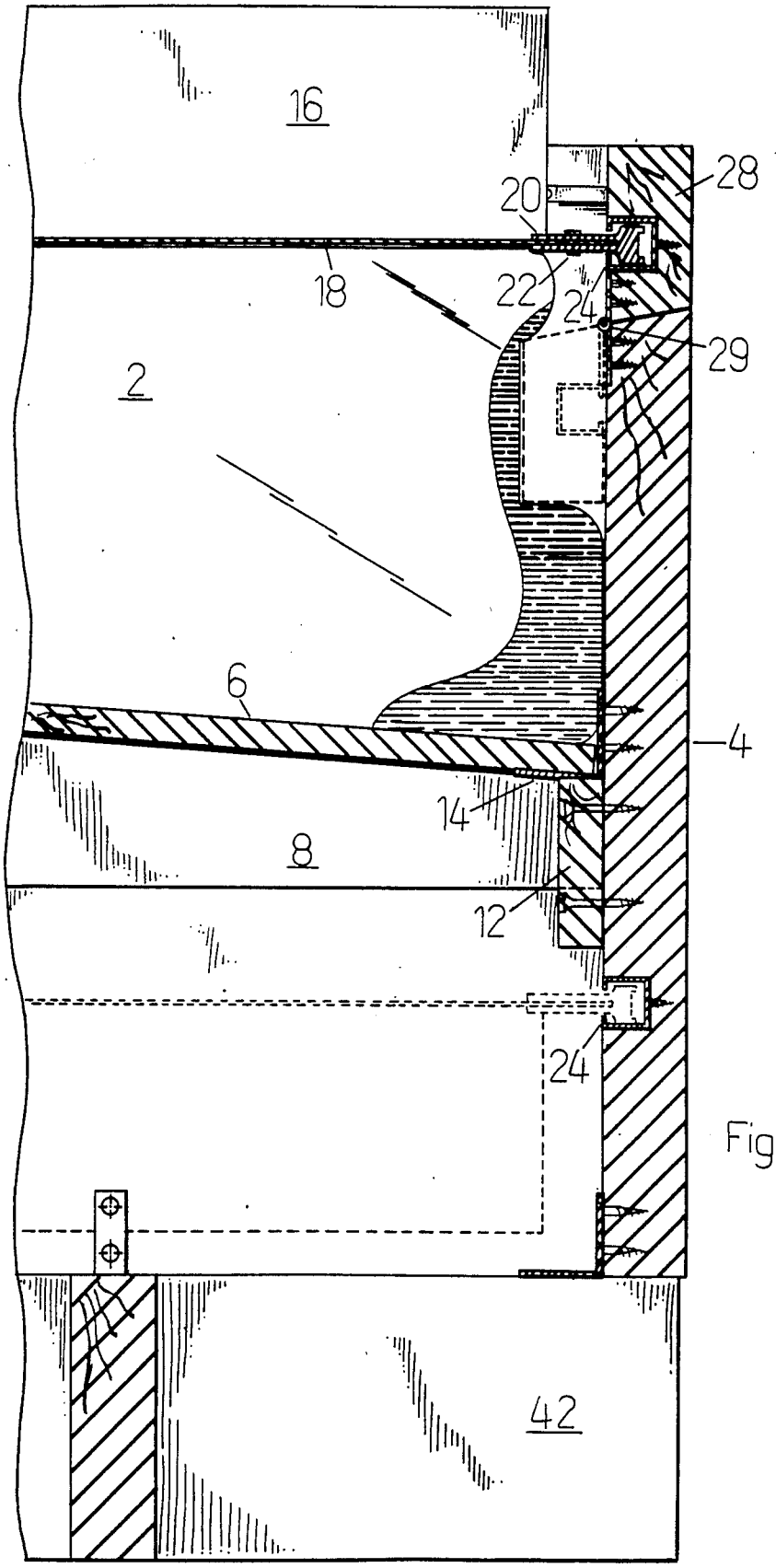
FIG. 4 is an enlarged sequencial cross-sectional view taken along line IV—IV of FIG. 2.
Figure 6:
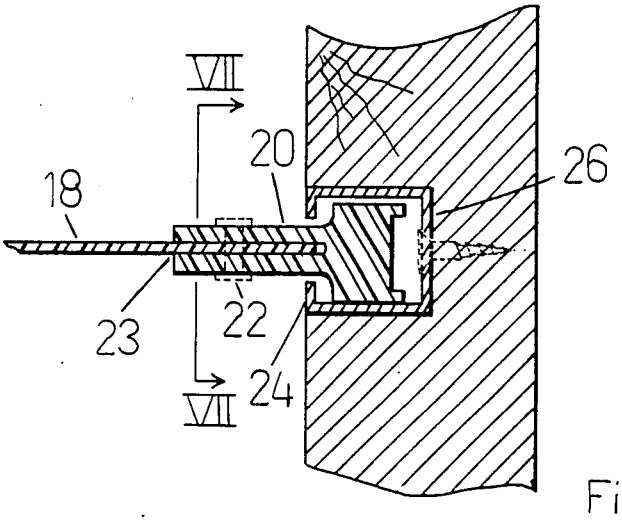
FIG. 6 is an enlarged cross-sectional view taken along line VI—VI of FIG. 5.
Figure 7:
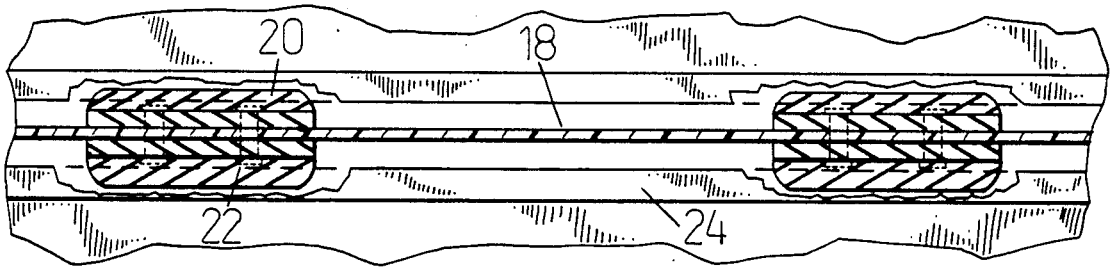
FIG. 7 is a cross-sectional view taken along line VII—VII of FIG. 6.

The guides 20 are T-shaped and are slidably supported in the track 24 as best shown in FIGS. 4 and 6 at the bottom surface of the crossed "T" section. The perpendicular leg of each guide 20 has a central slot 23 to allow the edge 18' of the plastic sheet 18 to fit inside slot 23. The plastic sheet 18 may be secured by rivets 22 through the guides 20. The slotted leg of the guide 20 also acts as a clamp for the edge of the plastic sheet 18 when the rivets 22 are secured to provide maximum gripping contact with the edge. The clamp action helps the plastic sheet 18 take stress applied at its edges during use. The foam mattress 16, plastic sheet 18, and guides 20 act as a unitary movable mattress unit.

Figure 5:
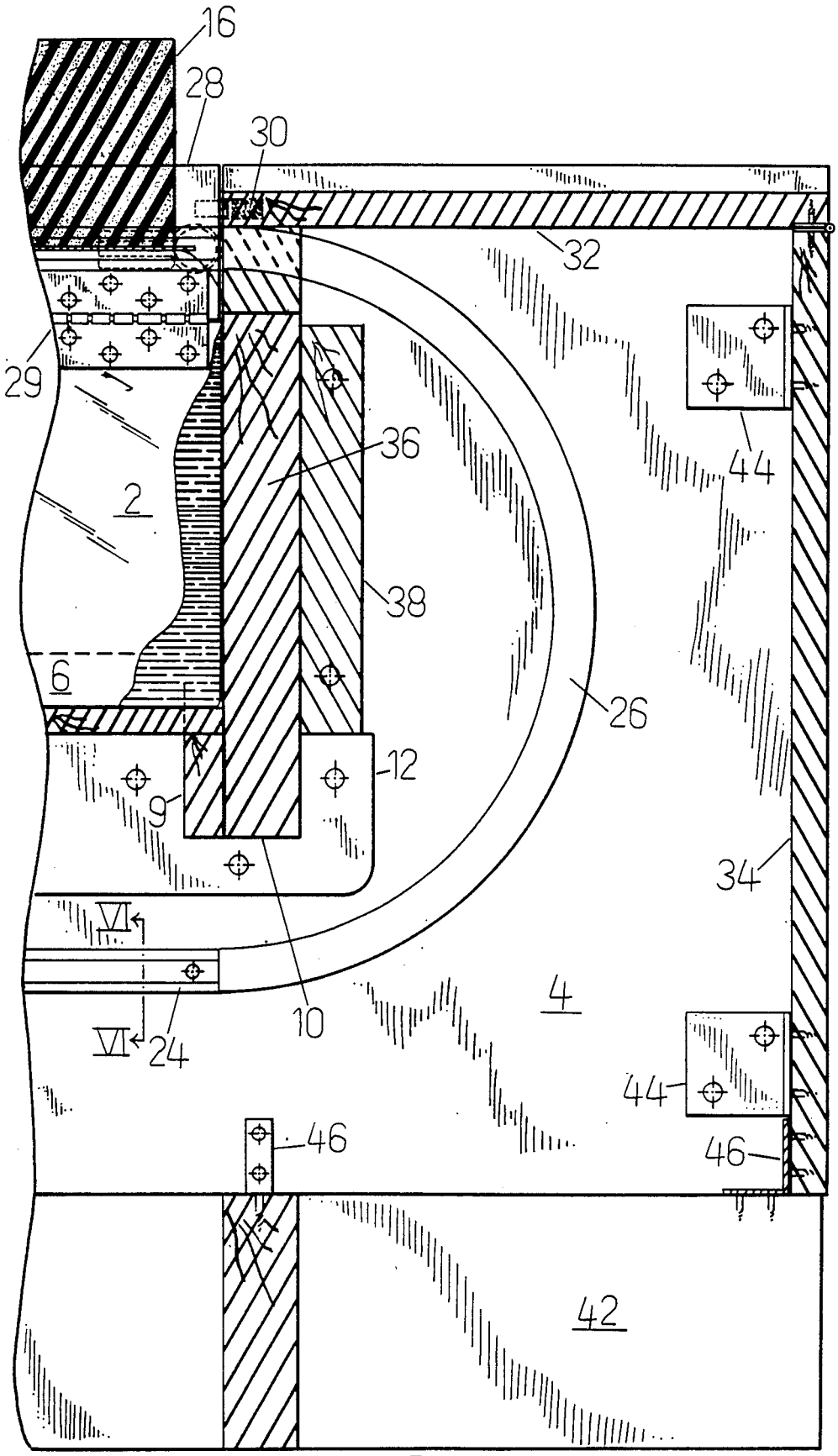
FIG. 5 is an enlarged sequencial cross-sectional view taken along line V—V of FIG. 1 showing the headboard and only with the headboard lid closed.

This mattress unit slides along the two tracks 24 which curve downward and back underneath the two attached support boards 12 on the longitudinal sides 4 as shown in FIGS. 2 and 5 to provide upper and lower track sections. The tracks 24 on either side 4 are horizontally parallel to one another. When the foam mattress is on the lower section of the tracks 24, it is in the storage position.

The storage position allows the use of the water mattress cell 2 alone. Hinged sections or side rails 28 extend along the upper edge of each side 4 and are folded inwardly and tucked away along the inside wall of each side 4. The double thickness produced by the folded side rails 28 make each side 4 top edge of the frame support structure 1 more suitable to sit on. The water mattress cell 2 is also more easily accessible.

Figure 8:
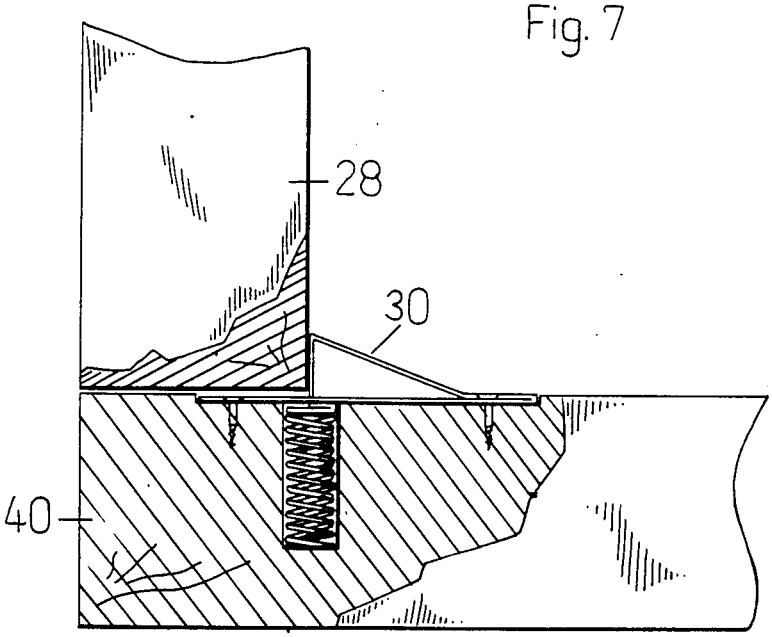
FIG. 8 is an enlarged cut-away view showing one of the spring-loaded lock clips for retaining the folding side rails in the raised position.

When the rails 28 are in the upright position, they are secured into place by spring loaded lock clips 30 located on end boards 40 at each end of the rails 28 as shown more clearly in FIGS. 5 and 8. Two of the lock clips 30' are affixed on the inward, outer edge of the hinged lid 32 on one end of the frame support structure 1.

The lid 32 covers the open cavity in one end board in which the curved portion of the channel 26 and track 24 are located and closes off the foam mattress unit storage area. The bottom edge of the inward end of the lid 32 rests on the top edge of the inner enclosure or retaining wall 36. Wall 36 helps contain the water mattress cell 2. A cavity on the outward side of wall 36 is the part of the storage area in which the curved section of each channel 26 and track 24 are located. When the lid 32 is in an erect position the tracks 24 can be traversed by the guides 20. When it is in a downward rest position it closes off the storage and lower portion of the tracks 24 and enables the rails 28 to lock in an upright position. The rails 28 can also be tucked or folded inward for use of the water mattress cell 2 when the lid 32 is down. Each rail 28 is mounted on a side 4 preferrably by a piano hinge 29, however, a plurality of hinges may also be used for this purpose.

The enclosure wall 36 rests in slot 10 on the side support boards 12 and is also supported in a vertical position on its outer end edges by blocks 38 or by brackets. A cross beam 9 is also mated with the enclosure wall 36 and fits at its ends into slots 10 on the support boards 12 on sides 4. An additional cross beam 9 is also mated to the opposite end board wall 40 of the frame support structure 1. These cross beams 9 at the ends of the mattress area also help support the plywood decking 6.

"L"-shaped brackets 44 and 46 may be used to attach the end boards 40 to the side boards 4 and the side boards 4 and end boards 40 to a cross-connecting interlocking base 42. Base 42 supports the frame support structure 1 on its bottom edge off the floor and equally distributes the bed weight over the floor area.

When the rails 28 are upright and locked into place by the clips 30 and the foam mattress unit is fully extended across the water mattress cell 2 and along the upper portion of the tracks 24, a combination bed is in position. Using the water mattress cell 2 as a base, the movable foam mattress unit mates on top of it. The tracks 24, guides 20, and plastic sheet 18 contain the movement of the water mattress cell 2 at a stable level when in use. This enables the foam mattress unit to utilize the water mattress cell 2 as a firm foundation.

I claim:

1. A waterbed comprising:

a bed frame;

first mattress support means on said bed frame for supporting a water-filled mattress;

a first water-filled mattress supported on said first mattress support means; and a second movable mattress movably supported on said bed frame for movement between a first storage position within said bed frame when said water-filled mattress is intended to be used and a second use position over said first mattress, so that said waterbed can be converted to a conventional bed by selectively moving said second mattress between said first and second positions.

2. A waterbed comprising:

a bed frame;

first mattress support means on said bed frame for supporting a first, water-filled mattress;

a flexible second movable mattress movably supported on said bed frame for movement between a first storage position within said bed frame when said water-filled mattress is intended to be used and a second use position over said first mattress, so that said waterbed can be converted to a conventional bed by selectively moving said second mattress between said first and second positions; and a flexible second support means movably mounted on said bed frame for movably supporting said second mattress for movement between said first and second positions.

3. A waterbed as claimed in claim 2 wherein said flexible second support means comprises:

a sheet member; and means for mounting said sheet member movably on said bed frame.

4. A waterbed as claimed in claim 3 wherein:

said bed frame comprises two side boards in relative spaced relationship; and said sheet member mounting means comprises slidable connecting means connected to opposite edges of said sheet member and slidably mounted in said side boards.

5. A waterbed as claimed in claim 4 and further comprising:

slots in said side boards for slidably receiving and guiding said connecting means to facilitate movement of said flexible support sheet and second mattress thereon between said first and second positions.

6. A waterbed as claimed in claim 5 wherein:

track means are mounted in said slots; and said slidable connecting means comprise substantially T-shaped guide members slidable in said track means.

7. A waterbed as claimed in claim 6 wherein:

said guide members are plastic.

8. A waterbed as claimed in claim 7 wherein:

each slot has a curved section adjacent one end of the respective side board to form a substantially U-shaped slot having upper and lower sections; and said flexible second mattress is attached to said sheet member.

9. A waterbed as claimed in claim 8 wherein:

said flexible second support means is positioned in said second use position so that said second mattress is supported above said first mattress.

10. A waterbed as claimed in claims wherein:

each slot has a curved section adjacent one end of the respective side board to form a substantially U-shaped slot having upper and lower sections; and said flexible second mattress is attached to said sheet member.

11. A waterbed as claimed in claim 2 wherein:

said flexible second support means is positioned in said second use position so that said second mattress is supported above first mattress.

* * * * *